United States Patent [19]

Neilsen

[11] Patent Number: 4,898,055

[45] Date of Patent: Feb. 6, 1990

[54] ADJUSTABLE MULTIPLE PAPER PUNCH

[76] Inventor: Hildaur L. Neilsen, 2 Juniper St., Metuchen, N.J. 08840

[21] Appl. No.: 285,108

[22] Filed: Dec. 15, 1988

[51] Int. Cl.[4] ..... B26F 1/04

[52] U.S. Cl. ..... 83/571; 83/549; 83/618; 83/687

[58] Field of Search ..... 83/620, 619, 618, 698, 83/549, 917, 571, 687

[56] References Cited

U.S. PATENT DOCUMENTS

| | | | |
|---|---|---|---|
| 1,124,305 | 1/1915 | Day | 83/619 X |
| 1,655,315 | 1/1928 | Finley | 83/618 X |
| 2,244,320 | 6/1941 | Unger | 83/618 X |
| 2,534,094 | 12/1950 | Yerkes | 83/549 X |
| 3,176,570 | 4/1965 | Gaya | 83/618 X |
| 3,392,913 | 7/1968 | Neilsen | 83/549 X |
| 4,449,436 | 5/1984 | Semerjian et al. | 83/549 X |
| 4,645,399 | 2/1987 | Scharer | 83/549 X |

*Primary Examiner*—Frank T. Yost
*Assistant Examiner*—Rinaldi Rada
*Attorney, Agent, or Firm*—Klauber & Jackson

[57] ABSTRACT

An improved paper punch construction has a body, several punching units carrying elements, and an actuating lever for actuating the punching elements, the lever normally not engaging the punching elements but each unit carrying a pivoted spacer for selectively causing the lever to actuate the associated punching element.

1 Claim, 1 Drawing Sheet

ADJUSTABLE MULTIPLE PAPER PUNCH

FIELD OF THE INVENTION

This invention relates to paper punches and is more particularly concerned with multiple paper punches of the type wherein an individual punching element may be selectively engaged and disengaged for punching operations.

BACKGROUND OF THE INVENTION

Paper punches of the type in which a plurality of punching elements perforate the paper inserted in the punch gap and pass through associated punch or die holes in the punch body are well known and are widely used in practically every office.

It is often desired to punch different numbers of holes, e.g., to provide two holes or three holes, or more, or to have the holes differently spaced apart so that the perforated paper will be suitable for different types of loose-leaf binders or for different standard types of binder clips, conventionally found in business offices.

For this purpose, punches have been developed in which the punching elements which produce the holes or perforations are constructed to be selectively engaged and disengaged. Constructions of this type are shown, for example, in Allen, U.S Pat. No. 746,625; Finley, U.S. Pat. No. 1,655,315; and Semerjian et al, U.S. Pat. No. 4,449,436.

To facilitate the binding of punched or perforated sheets in files or binders fasteners of a kind commonly used to bind sheets in a file are conventionally furnished in a plurality of standard sizes: that is, the fasteners are formed with prongs or like elements, spaced apart at different distances to be extended through holes punched in the paper sheets. Other kinds of file folders, such as for example, those having ring or post binders, often have differently spaced rings or posts, thus also necessitating selected variations in the spacing of the perforation in the sheets to be filed in the folders.

Known types of paper punches commonly used to perforate sheets to receive or be received in binders or folders frequent have punch elements which may be selectively engaged or disengaged. Such paper punches having selectively engageable punches frequently embody complicated and costly constructions. Furthermore, they are often incapable of simple and easy manipulation and operation by inexperienced operators and, hence, are unsuited for general office use.

OBJECTS OF THE INVENTION

It is, of course, desirable that the cost of manufacture of such punching apparatus shall be as low as possible and at the same time the apparatus shall be strong, reliable and durable, and that it be easy to operate, even by unskilled users.

It is therefore, an object of the invention to provide a paper punch which is of non-complicated, sturdy construction and capable of being manufactured at low cost and yet which will insure clean-cut and accurate perforations of paper sheet, and the like.

It is another object of the invention to provide a punch of the character indicated comprising a novel and improved construction.

Another object of the invention is to provide a punching or perforating apparatus which includes a novel and improved combination of a base and a plurality of punches, wherein selectively certain of the punches can be utilized for punching operations while other punches are disengaged and out of operation and are at rest.

BRIEF SUMMARY OF THE INVENTION

These and other objects of the invention are achieved by an improved paper punch construction which embodies a plurality of punching elements and a plurality of cooperating die holes, wherein each punching element cooperates with a frame which is constructed to permit the punching element to be selectively engaged or disengaged from actuation by an operating lever, whereby selective spacing of the perforations made by the punch may be achieved. More particularly, each punching element is mounted for reciprocation in the frame and has a stem normally not positioned for engagement by the actuating lever but there is provided in the frame a pivoted spacer for ensuring engagement of the stem by the actuating lever, when desired.

BRIEF DESCRIPTION OF THE DRAWINGS

Other objects and features of the invention will be readily apparent from the accompanying drawings, wherein.

DETAILED DESCRIPTION OF THE INVENTION

Figure 1:
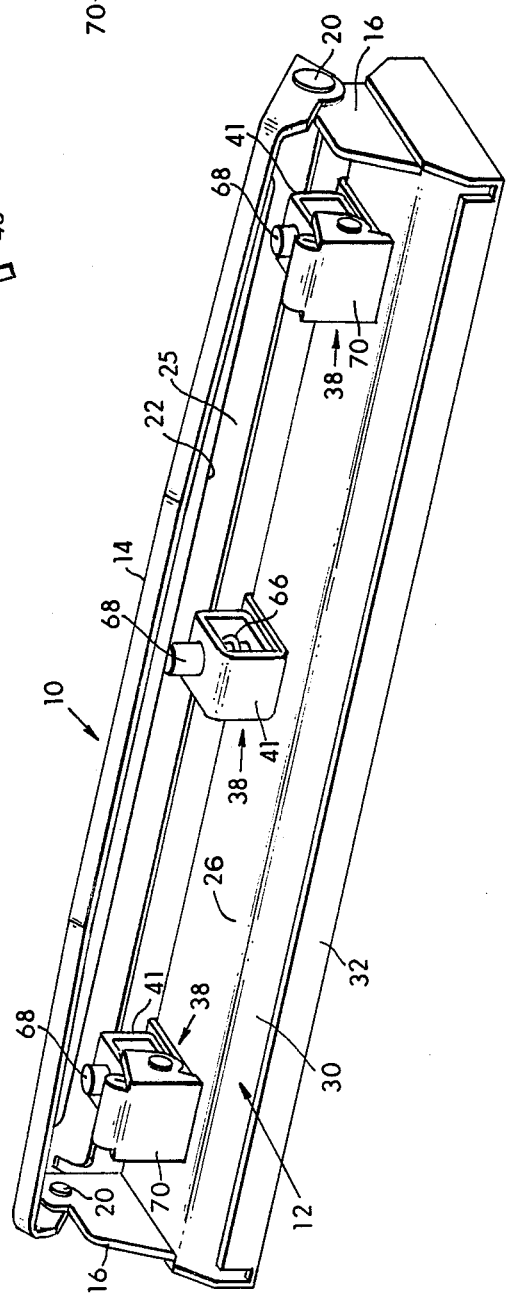
FIG. 1 is a perspective view of a paper punch embodying features of the present invention.

Referring now to the drawings, and particularly to FIG. 1, a paper punch designated generally by the reference numeral 10, has a body 12 and an elongated actuating lever 14. The body 12 is bent up at its ends to define end supports 16 to which the lever is hinged, e.g., by means of rivets, as shown at 20. The actuating lever 14 has a downwardly-extending rib 22 which is formed by a corresponding depression 24 in its upper surface, and a rear flange 25. The body 12 has a supporting surface 26 and downwardly-extending flanges 28 and 30 at its sides extending between end supports 16. Cooperating with flanges 28 and 30 is a bottom member or cover 32 which removably engages the flanges and the ends of body 12 to define a chamber for receiving the punched-out paper. The bottom member 32 may be conveniently formed from metal or plastic, the latter being preferred. The actuating lever 14 and the base 10 are suitably formed from sheet steel, bent and shaped to provide the structure illustrated and forming a relatively inexpensive structure.

Figure 2:
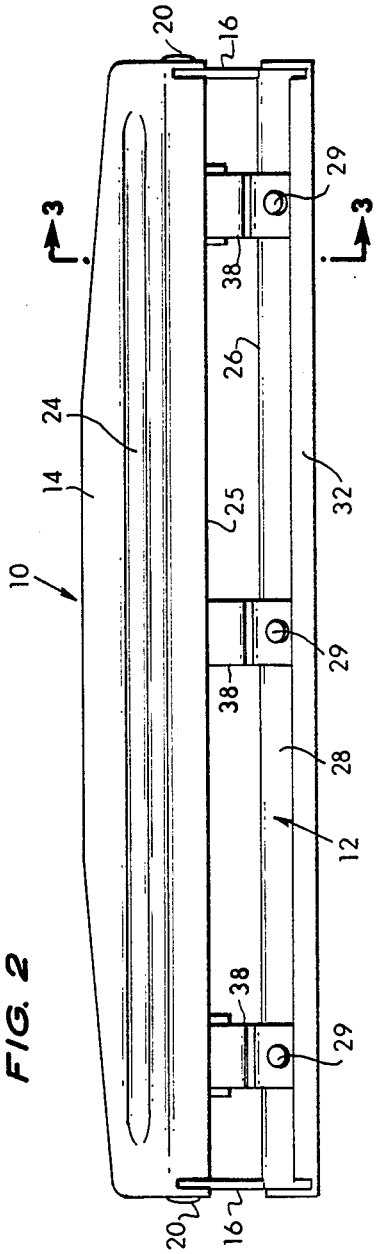
FIG. 2 is a side elevational view of the paper punch shown in FIG. 1.

It is to be understood that the paper punch body shown in FIGS. 1 and 2 and described above is merely illustrative of punch bodies which can be embodied in the punch construction of the invention and the invention is in no way limited to its exact construction and shape.

In accordance with the invention, the paper punch 10 is provided with a plurality of punching units 38 which produce the perforations or holes in the paper when the actuating lever 14 is depressed. Each punching unit 38 comprises a bracket or frame 41 having a base 42 which is constructed to lie upon the supporting surface 26 of body 12 and which has a tongue 43 at its forward end which overlies flange 28 and is rigidly secured thereto, as by a rivet 29. The base 42 of each bracket or frame 41 is formed with a die hole 44 which cooperates with an aperture (not shown) of equal size formed in supporting surface 26, and frame 41 is suitably accurately positioned on base 42 by means of appropriate guidance projections (not shown) formed in base 42. The bracket or frame 41 of each punching unit 38 further includes a back wall 50, a top 52, a forward wall 54 and a bottom wall 56 which is parallel to the base 42 to define a slot 58 for the paper to be punched or perforated. The bottom wall 56 also has an aperture 60 which is aligned with die hole 44. Conveniently, the frame 41 is formed from a single metal strip which is bent and shaped to define base 42 with its die hole, tongue 43, back wall 50, top 52, forward wall 54 and bottom wall 56 with its aperture.

Disposed in bracket or frame 41 of each punching unit 38 is, a punching element or die 62 which has a collar 64 encircling it. The punching element or die 62 is biased upwardly by means of a spring 66 disposed between collar 64 and bottom wall 56 and the punching element 62 is positioned in frame 41 so that it passes through the aligned aperture and die hole.

The lower end of punching element or die 62 is appropriately shaped to be effective to perforate one or more sheets of paper inserted in slot 58, e.g., such as shown in the abovementioned Semerjian et al, U.S. Pat. No. 4,449,436, or in my co-pending application Ser. No. 21,999, filed Mar. 5, 1987, now abandoned, both of which are incorporated here in by reference.

In a conventional paper punch, the stem of the punching element is normally depressed to actuate the element to punch paper when the actuating lever of the paper punch is depressed, as in the punches disclosed in the above-mentioned patent and application.

Figure 4:
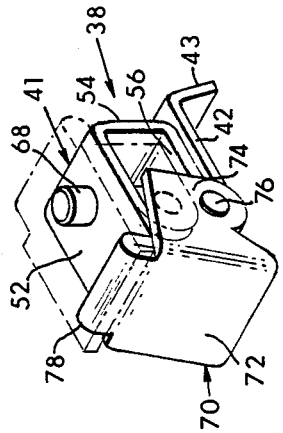
FIG. 4 is a perspective view of one of the punching units shown in FIG. 1, illustrating its engaged and disengaged position.
Figure 3:
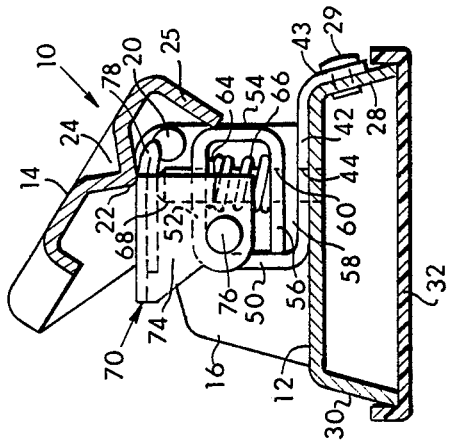
FIG. 3 is a cross-sectional view taken approximately along the line 3—3 of FIG. 2, but on an enlarged scale.

In accordance with the present invention, however, the stem 68 of punching element or die 62, which may be rounded at its end, if desired, as shown, is sufficiently short that it is not engaged by rib 22 of actuating lever 14 when the lever is depressed, i.e., when lever 14 is pivoted downwardly around hinges 20. There is, however, provided a pivoted spacer member which, when it is placed in its active position, causes the stem of the punching element or die 62 to be activated by the lever 14. This spacer member, designated generally by the reference numeral 70 comprises a body 72 and two wings 74 extending downwardly from either side of the body 72. Body 72 is substantially planar but preferably is slightly sloped downwardly at one end to facilitate engagement and disengagement of punching unit 38 in paper punch 10. A pivot pin 76 extends between wings 74 and through the space behind stem 68 and 66 defined by bottom wall 56, back wall 50 and top 52, as seen in FIG. 4. The body 72 and wings 74 are conveniently formed from a single metal strip cut and shaped to the illustrated structure. As mentioned, the body is sloped downwardly at its end away from pivot pin 76 and the metal strip forming it is retroverted and its retroverted end underlies part of body 72, to increase its thickness as indicated at 78. Alternatively, the retroverting may be omitted and the end edge of the strip forming body 72 may be merely rounded or smoothed.

In any case, the body 72, with or without the retroverted end 78 is of a thickness that, when punching unit 38 is to be engaged, spacer element 70 is pivoted so that body 72 is caused to overlie stem 68, with the result that rib 22 is engaged, so that upon downward pivoting of lever 14, will cause the associated punching element 62 to be actuated.

When it is desired to disengage a punching unit 38, it is merely necessary to pivot the spacer member 70 rearwardly, as seen in FIG. 4. This will cause a free space to be left between stem 68 and rib 22 so that downward pivoting of actuating lever 14 will not cause punching unit 38 to be actuated, and the punching element 62 will be left at rest.

Figure 5:
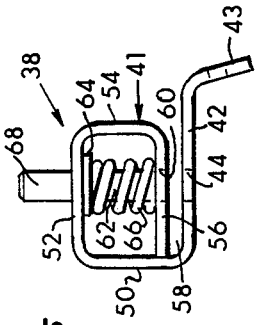
FIG. 5 is a side elevational view of a punching element without the spacer feature of the invention.

In order for actuating lever 14 to be returned to and maintained at its upward or rest position after each depression or actuation, the spacer element 70 is omitted from one of the punching units as above described, advantageously the center one, and in that punching unit, the length of the stem 68 of its punching element 62 is extended so that it continually engages the rib 22 of lever 14. This is shown in FIGS. 1 and 5. When the stem 68 is urged upwardly by reason of spring 66 acting on collar 64, the lever 14 is also urged to pivot upwardly. Excess upward pivotal movement of lever 14 is prevented by the engagement of rear flange 25 against the forward walls 54 of the frames 41, of the punching units as seen in FIG. 1. It is contemplated that the punch have three or five punching units, with one of them having the spacer member 70 omitted and the stem 68 elongated as described above.

It will be obvious that various other changes and modifications can be made without departing from the invention as defined in the appended claims and it is intended, therefore, that all matter contained in the foregoing and in the accompanying drawings shall be interpreted as illustrative only and not as limitative.

I claim:

1. A punching unit for use in a punch having a body and a punch-actuating lever pivoted thereto, said punching unit comprising a body defining a die hole, a punching element in the nature of a die reciprocably positioned in said punching unit body for cooperation with said die hole, and pivoted spacer means carried by said punching unit for movement into and out of overlying relationship with said punching element, whereby said spacer means adds to the length of said punching element when it is pivoted into over-lying relationship therewith, said unit having a substantially square frame, said spacer element having a substantially planar body with spaced-apart wings downwardly-extending from opposite sides of said body and a pivot pin connecting said wings within said body.

* * * * *